US005647381A

United States Patent [19]

Rainer

[11] Patent Number: 5,647,381

[45] Date of Patent: Jul. 15, 1997

[54] BEACH ASH TRAY

[76] Inventor: Edward S. Rainer, 1098 Indian Hill Rd., Toms River, N.J. 08753

[21] Appl. No.: 663,662

[22] Filed: Jun. 14, 1996

[51] Int. Cl.[6] ..... A24F 19/00

[52] U.S. Cl. ..... 131/235.1; 131/240.1; 131/242.6

[58] Field of Search ..... 131/231, 235.1, 131/240.1, 241, 242.6

[56] References Cited

U.S. PATENT DOCUMENTS

| | | | |
|---|---|---|---|
| D. 123,087 | 10/1940 | Koch . | |
| D. 145,739 | 10/1946 | Lomasney . | |
| D. 170,345 | 9/1953 | Vevrit | 131/240.1 X |
| 1,228,508 | 6/1917 | Wise, Jr. | 131/242.6 |
| 1,829,844 | 11/1931 | Altmayer | 131/235.1 |
| 2,494,629 | 1/1950 | Randel | 131/242.6 |
| 3,141,441 | 7/1964 | Russell | 131/235.1 X |
| 4,027,683 | 6/1977 | Lawbaugh | 131/235.1 |
| 5,020,549 | 6/1991 | Wojcik . | |

FOREIGN PATENT DOCUMENTS

| | | | |
|---|---|---|---|
| 1064241 | 5/1954 | France | 131/240.1 |

*Primary Examiner*—Jennifer Bahr
*Attorney, Agent, or Firm*—Terrance L. Siemens

[57] ABSTRACT

An ash tray having a receptacle having a peripheral wall and a perforated floor. An outwardly oriented radial flange projects from the peripheral wall receptacle at a level even with reliefs formed in the wall for enabling cigarettes to pass through the wall. This arrangement enables a cigarette to be rested on the flange, with the burning end of the cigarette disposed over the receptacle. The ash tray is used at a beach or other sandy environment, and is maneuvered into the sand until the receptacle of the ash tray partially fills with sand. When a smoker is finished smoking, the ash tray is elevated above the supporting sand. Sand and ashes contained within the receptacle escape from the receptacle. Cigarette butts and other large waste particles are retained for subsequent disposal.

5 Claims, 1 Drawing Sheet

BEACH ASH TRAY

BACKGROUND OF THE INVENTION

1. Field of the Invention

The present invention relates to an ash tray, and more particularly to an ash tray which interacts with a supporting sand stratum. The ash tray has a perforated floor, so that sand can pass through the floor, into the tray, when the ash tray is placed on the sand. The sand serves as a suitable medium for extinguishing embers of smoking products, such as cigarettes. When removing the ash tray from the supporting stratum, the sand and fine wastes, such as ashes, pass through the perforated floor and return to the environment. Larger waste or debris particles, such as cigarette butts and filters, are entrapped within the ash tray for subsequent disposal.

2. Description of the Prior Art

Smoking is a pleasurable activity to many. Smoking creates wastes which, if not properly disposed, create objectionable and unsightly disturbances to the environment. Ash trays and other receptacles are provided for collecting waste and debris for subsequent disposal.

Separation of ash from larger waste particles is known in the prior art. An ash tray shown in U.S. Pat. No. 2,494,629, issued to George V. Randel on Jan. 17, 1950, has an internal mesh for separating ash from larger portions of the smoking product, such as cigarette butts. However, Randel provides inner and outer receptacles, the inner receptacle being that having the mesh. The outer receptacle therefore separates the inner receptacle from contact with sand or other environmental substances, unlike the purposefully unprotected receptacle of the present invention. It should also be noted that Randel's device lacks a broad horizontal flange provided in the present invention.

Ash trays may also control rate of combustion and quantity of smoke emitted by a cigarette which is temporarily laid aside by a smoker. U.S. Pat. No. 5,020,549, issued to Tadeusz P. Wojcik on Jun. 4, 1991, describes an ash tray intended for controlling the burning rate of cigarettes which are temporarily laid aside by the user. These cigarettes occupy combustion chambers having controlled access to air for combustion. There is no mesh or screen for admitting sand or like material into a cigarette receptacle, as provided in the present invention. Nor is there a broad external flange, as seen in the present invention.

Neither one of the above inventions and patents, taken either singly or in combination, is seen to describe the instant invention as claimed.

SUMMARY OF THE INVENTION

The present invention provides an ash tray which is particularly suited for beaches and similar locations having sandy ground soils. In particular, persons engaged in relaxing at beaches are well served by the novel ash tray. Beach and similar recreational environments are usually lacking in convenient facilities for temporarily holding cigarettes and other smoking products and for disposing of smoking wastes.

Conventional ash trays have minimal ability to prevent ashes from blowing in air currents and for protecting cigarettes from contamination with sand. Some ash trays may have proportions and configurations for accomplishing these objectives, but would typically be unduly large, cumbersome, or complicated in construction.

The novel ash tray has a receptacle characterized by a perforated or mesh floor. The openings are of predetermined dimensions suitable for passing sand into the receptacle, while preventing matches and cigarette butts and filters from escaping from the receptacle.

A broad flange projects radially outwardly from the ash receptacle. The flange is sufficiently broad to provide a surface which interferes with the sand, so that the ash tray can be easily maneuvered into sand a limited distance. Also, the flange protects cigarettes temporarily supported on the ash tray from contamination by contact with sand or soil.

Preferably, the flange is flat, rather than grooved or sculpted to hold cigarettes. Recesses formed in the upright walls of the receptacle provide the function of preventing cigarettes from rolling away.

The present invention thus provides structure of minimal complexity which affords retention of larger waste particles, but enables escape of ashes into the ground. This characteristic would be unacceptable indoors, but is perfectly acceptable outdoors. Cigarette ash is biocompatible and sufficiently fine to be dispersed in sand without risk of contaminating clothes and furnishings which are typically absent in a beach environment. By contrast, cigarette butts, extinguished matches, and other large particles are resistant to natural decomposition and assimilation into the ecosphere.

Moreover, construction of the novel ash tray requires no moving parts nor even separable parts. Such an ash tray is therefore immune to clogging and contamination in an outdoor environment, is inexpensive to fabricate, and is easily cleaned. Smoking wastes, such as extinguished matches and cigarette butts and filters, are readily discarded. No messy or involved procedure is required to empty the ash tray when the smoker has finished smoking.

The novel ash tray exploits the sand present at a beach or similar natural environment. When the ash tray is maneuvered into the sand, sand enters the ash receptacle. This sand provides an ideal medium for extinguishing cigarettes when desired and for suppressing smoke emitted by cigarettes. When the smoker is finished smoking, mere removal of the ash tray from the sand separates ash from larger wastes. Ash and sand fall through the perforated floor of the receptacle. Larger particles are retained for suitable subsequent disposal.

Accordingly, it is a principal object of the invention to provide an ash tray which separates fine wastes from larger waste particles, and biocompatible wastes from wastes resistant to natural decomposition.

It is another object of the invention to exploit environmental sand as a combustion suppressant, and to readily discard sand so exploited when a smoker is finished smoking.

It is a further object of the invention to provide a flange for preventing the ash tray to be maneuvered excessively deeply into sand.

Still another object of the invention is to protect cigarettes temporarily held on the ash tray against contamination by sand or other soil substances.

An additional object of the invention is to provide a flat surface for bearing indicia without distorting the indicia.

It is again an object of the invention to provide means for preventing cigarettes temporarily held by the ash tray from rolling about.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
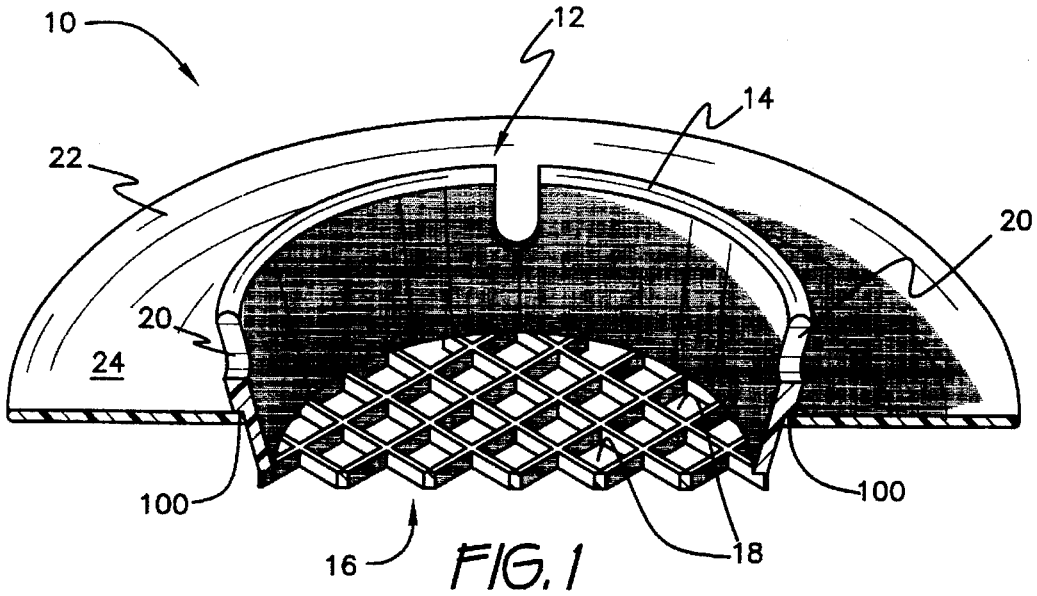
FIG. 1 is a perspective view of the invention, shown partly in cross section.

Turning now to FIG. 1 of the drawings, the novel ash tray 10 comprises a receptacle 12 defined within upright peripheral wall 14 and above horizontal floor 16. Upright peripheral wall 14 is seen in the FIGURES to be, in the preferred embodiment described herein, a generally frustoconical shape with the floor 16 having a reduced diameter in relation to the diameter dimension of the opening 26, seen in FIG. 2. Floor 16 is perforated, having openings 18. Openings 18 are of predetermined maximum diameter less than the diameter of a cigarette. This relationship assures that cigarette butts and filters will be retained within receptacle 12 when ash tray 10 is elevated, or lifted above a supporting surface (see FIG. 2). Openings 18 may be bored into or molded integrally with floor 16, or may be provided by forming floor 16 as a screen or mesh. Wall 14 has recesses or reliefs 20 formed therein, for receiving a cigarette (see FIG. 2) and stably supporting the cigarette. Also, on the outer side of wall 14 there is seen a travel stop 100 (seen in both FIGS. 1 and 2). This travel stop 100 serves to aid in the correct placement of the outwardly projecting, horizontally oriented flange 22, as will be discussed further hereinbelow.

An outwardly projecting, horizontally oriented flange 22 is disposed around receptacle 12. This flange 22 serves three purposes. One purpose is to support and stabilize ash tray 10 when ash tray 10 is placed on a sand stratum of a sandy environment (see FIG. 2), as will be explained hereinafter. A second purpose is to support and balance a cigarette when the cigarette is set aside temporarily by a smoker. The third purpose is to provide a surface for bearing indicia (not shown). Flange 22 has a flat upper surface 24, so that indicia is not distorted by a curved or irregular surface.

Figure 2:
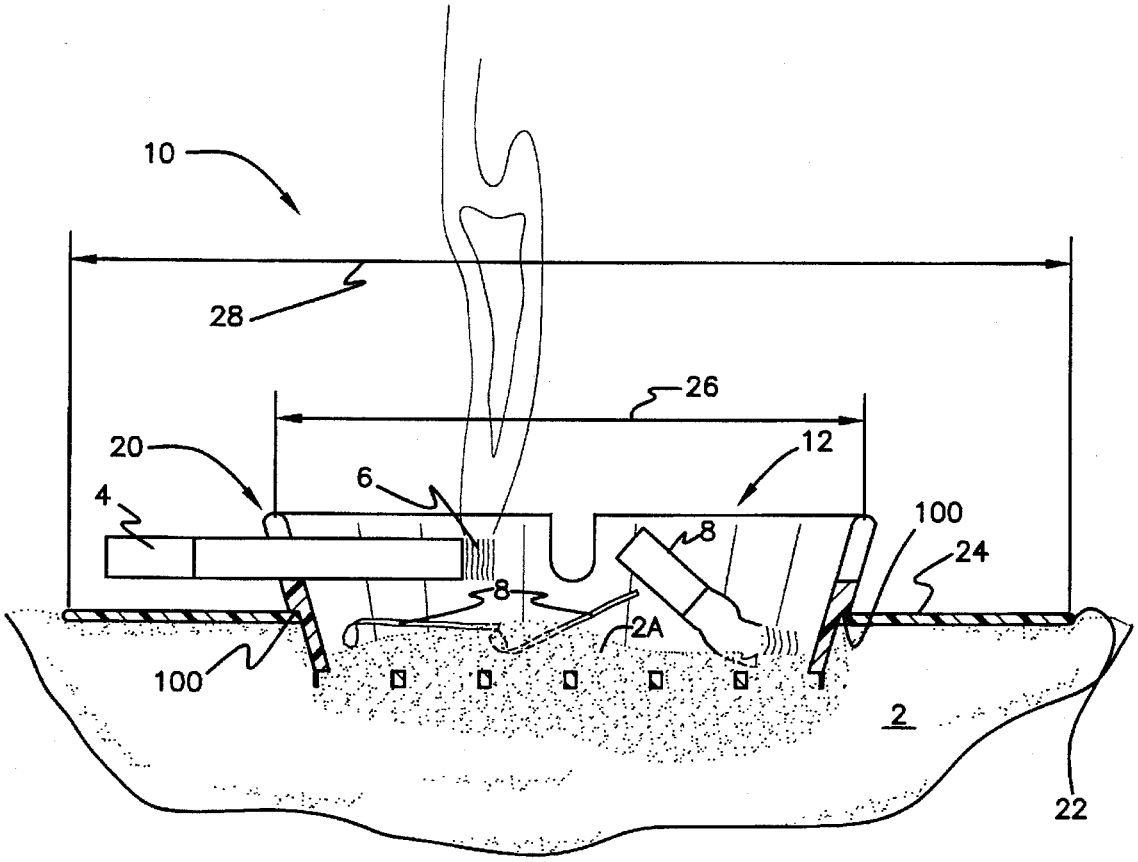
FIG. 2 is an environmental, cross sectional, side elevational view of the invention.

FIG. 2 shows ash tray 10 in its environment. Ash tray 10 is utilized by placing it on a sand stratum 2. Some sand 2A is placed within receptacle 12. Underlying sand 2 prevents sand placed within receptacle 12 from escaping. Sand placed within receptacle 12 may be scooped from stratum 2 and poured into receptacle 12. Alternatively, to avoid scattering sand on upper surface 24 of flange 22, ash tray 10 may be placed on stratum 2 and maneuvered under pressure to penetrate into stratum 2. Flange 22 assists in indicating and maintaining ash tray 10 level when supported on stratum 2. Flange 22 also prevents a person from pressing or maneuvering ash tray 10 excessively deeply into sand stratum 2.

As seen in FIG. 2, a smoker (not shown) will place a cigarette 4 on ash tray 10 temporarily from time to time. It is desirable to avoid having sand present on the upper surface 24 of flange 22, as this sand will inevitably adhere to the exterior of cigarette 4 when cigarette 4 is supported on flange 22. This is objectionable to the smoker. For this reason, as well as for leveling and for being sufficiently large to support cigarette 4, flange 22 is quite broad.

Receptacle 12 has a diameter dimension, as indicated at 26. The outer diameter of flange 22, indicated at 28, is preferably at least twice as great in magnitude as the diameter of receptacle 12. Regardless of the selected ratio of diameters, flange 22 protrudes outwardly from receptacle 12 a distance equal to at least half of the length of a cigarette. This distance assures that sufficient surface area is provided to balance cigarette 4 when placed on flange 22, rather than overhang receptacle 12 excessively, or, alternatively, fall onto sand 2.

Cigarette 4 may be rested on upper surface 24 of flange 22, and will protrude through a relief 20, so that the burning end overlies receptacle 12. Cigarette 4 is prevented from rolling on flange 22 due to partial encirclement by relief 20. Relief 20 has a lowermost point which is disposed level with upper surface 24 of flange 22, so that cigarette 4 lies parallel to and abutting upper surface 24, even while extending into receptacle 12.

Ashes 6 will fall into receptacle 12 and be retained in sand 2A. Large particles of waste 8, such as cigarette butts, cigarette filters, and spent matches, may also be discarded in receptacle 12. When the smoker is finished smoking, or wishes to leave the beach, disposal of sand 2A, ashes, and waste 8 is quickly and conveniently accomplished. Ash tray 10 is elevated, or lifted out of the supporting stratum 2, and shaken. Sand 2A and fine ash will escape through openings 18. Waste 8 will be retained for suitable subsequent disposal.

Thus it will be seen that ash tray 10 is suitable for use in a sandy environment, for collecting and storing ash and large particles of waste from smoking products. Ash tray 10 will retain the large particles of waste while enabling ready escape of ash and sand back to the natural environment.

It is to be understood that the present invention is not limited to the embodiments described above, but encompasses any and all embodiments within the scope of the following claims.

I claim:

1. An ash tray for use in a sandy environment comprising:

a receptacle portion having a generally upright peripheral wall and a generally horizontal floor;

a plurality of openings disposed in said generally horizontal floor;

an outwardly projecting flange dimensioned and configured to engage with and completely circumscribe said generally upright peripheral wall of said receptacle portion;

travel stop means disposed on said generally upright peripheral wall such that when said outwardly projecting flange is engaged with said generally upright peripheral wall and said travel stop means, said outwardly projecting flange extends outward therefrom, and is substantially parallel to said generally horizontal floor, whereby:

said flange is engaged with said generally upright wall and said ash tray thus may be inserted partially into the sand with said receptacle thus being partially filled with sand by virtue of said openings disposed in said horizontal floor, and when said ash tray is removed from the sand after use, any large waste particles are retained within the receptacle while allowing ash and sand to escape.

2. The ash tray according to claim 1, wherein said outwardly projecting flange, when engaged with said receptacle, provides an overall outer diameter at least twice that of said generally upright peripheral wall, such that said flange supports said ash tray when said ash tray is depressed into sand and additionally prevents further penetration into the sand.

3. The ash tray as claimed in 2, wherein said peripheral wall further includes at least one partial recess, said partial recess dimensioned and configured such that when said flange is engaged with said peripheral wall, said recess has a point located proximate to said engaged flange, and where said recess provides a means for receiving a cigarette such that the cigarette may rest partially on said engaged flange and also extend through said peripheral wall.

4. The ash tray as claimed in claim 1, wherein said generally upright peripheral wall describes a frustoconical shape, such that said generally horizontal floor has a smaller diameter than the distal end of said receptacle portion.

5. The ash tray as claimed in claim 1, wherein said openings in said generally horizontal floor are less than the diameter of a cigarette, whereby the cigarette is retained within said receptacle portion when said ash tray is removed from the sand.

* * * * *